US006782727B2

(12) United States Patent
Matzen

(10) Patent No.: US 6,782,727 B2
(45) Date of Patent: Aug. 31, 2004

(54) METHOD AND SYSTEM FOR SUPPORT AND/OR TRANSPORT OF A WIRE

(75) Inventor: Klaus Peter Matzen, Silkeborg (DK)

(73) Assignee: Enkotec A/S, Skanderborg (DK)

( * ) Notice: Subject to any disclaimer, the term of this patent is extended or adjusted under 35 U.S.C. 154(b) by 133 days.

(21) Appl. No.: 10/161,253

(22) Filed: May 31, 2002

(65) Prior Publication Data

US 2003/0221473 A1 Dec. 4, 2003

(51) Int. Cl.[7] ..... B21F 23/00
(52) U.S. Cl. ..... 72/186; 83/310; 470/122
(58) Field of Search ..... 72/185, 186, 187, 72/196, 197; 470/117, 122; 83/310, 322; 140/147

(56) References Cited

U.S. PATENT DOCUMENTS 597,211 A * 1/1898 Winne ..... 140/147
2,074,966 A * 3/1937 Little ..... 72/195
2,327,894 A * 8/1943 Hodgson et al. ..... 72/186

* cited by examiner

*Primary Examiner*—Lowell A. Larson
(74) *Attorney, Agent, or Firm*—Pitney, Hardin, Kipp & Szuch LLP

(57) ABSTRACT

The present invention relates to a method of and a system for carrying out at least one operation on at least one wire(1) in a wire forming manufacturing machine, said operation involving deformation of at least a part of the wire, said machine comprising at least two counter-rotating synchronized blocks(2,4), said blocks each comprising at least one operation means(6,7) for performing said operation. The new and characterizing aspects involve that at least two co-operating following means(8,10) temporarily engage the wire, said engagement starting at least before or during the at least one operation, where at least one of said following means(8) is rotating with an axis of rotation parallel to a first block(2) and at least one second following means(10) is rotating with an axis of rotation parallel to a second block (4), and where the rotation of said following means is synchronized with the rotation of at least one block, and where the following means in a first phase of engagement is gradually yielding and in a second phase of engagement gradually expanding to follow the wire.

18 Claims, 7 Drawing Sheets

METHOD AND SYSTEM FOR SUPPORT AND/OR TRANSPORT OF A WIRE

Figure 1:
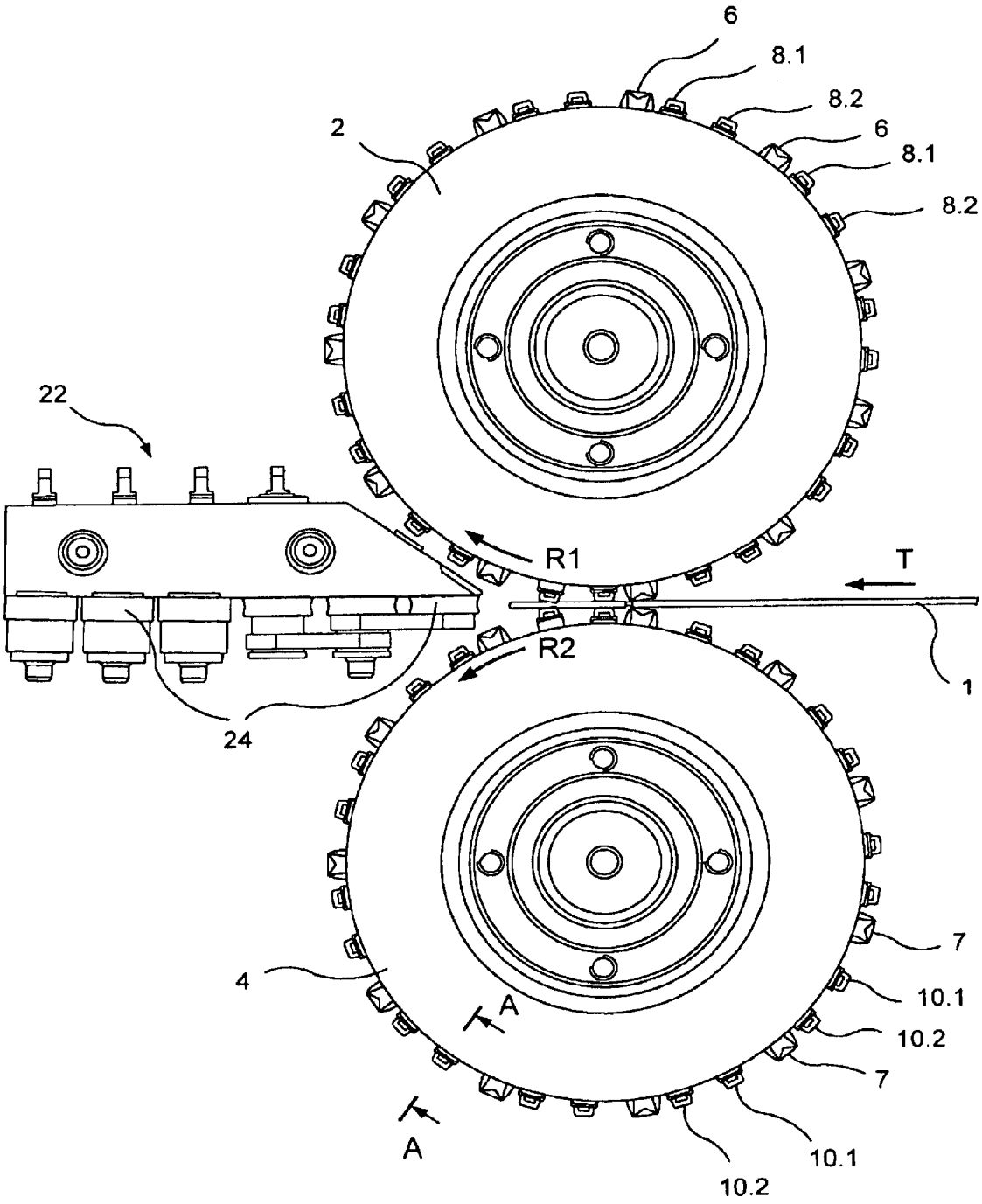

The present invention relates to a method of carrying out at least one operation on at least one wire in a wire forming manufacturing machine, said operation involving deformation of at least a part of the wire, said machine comprising at least two counter-rotating synchronised blocks, said blocks each comprising at least one operation means for performing said operation. The invention furthermore comprises a system incorporating the aforementioned method.

When manufacturing items from a wire, such as nails, spikes etc., the wire is fed into a manufacturing machine, where the wire is cut into blanks of a desired length. After cutting, the blanks are moved by a transport unit to a station where the head and other features are formed. Normally the cut forms both the acute end to the one side and to the other side, the end for e.g. the nail head. The section of the wire, which is to be cut of, is gripped by a transport unit just before or under the cutting operation, so that the wire is at most supported by the feeding equipment for feeding the wire from the coil and the transport unit. The distance between the transport unit and the feeding equipment is often substantial, whereby the wire may randomly be bending slightly over said distance. This phenomenon may lead to poorer quality of the acute ends and of the heads, because the cuts are randomly off centre due to the slight bending of the wire. Also, due to the bending of the wire, some blanks may enter the transport unit off centre, whereby they may be tilted and cause a malfunction.

The transport unit must have a safe grip on the wire before the cut is completed since the blanks may otherwise be lost or dropped, which would lead to malfunction. When using cutters mounted on rotating blocks, the size of the blocks determines how close the transport unit may be placed to the position in the cutting operation, where the blank is separated from the wire, and in effect thereby also the minimum length of the blank. This is an undesired limitation of the machinery.

One objective of the present invention is to provide a method of improving the quality of the cutting operation, or another deformation operation of a wire, by stabilising and supporting the wire during said operation. Another objective is to provide a method, where the blanks may be cut into shorter lengths compared to the known technique. A further objective is to provide a system to incorporate the aforementioned method and aspects of said method.

The new and characterising aspects of the method according to the invention involve that at least two co-operating following means temporarily engage the wire, said engagement starting at least before or during the at least one operation, where at least one of said following means is rotating with an axis of rotation parallel to a first block and at least one second following means is rotating with an axis of rotation parallel to a second block, and where the rotation of said following means is synchronised with the rotation of at least one block, and where the following means in a first phase of engagement is gradually yielding and in a second phase of engagement gradually expanding to follow the wire.

By the new and characterising aspects of the method it is obtained, that the following means by their engagement with the wire stabilize and support the moving wire during the operation. Also, it is obtained that the following means may transport the blanks from the position, where they are separated from the wire, and over a distance to safe engagement with a transport unit. By these aspects both an improved as well as a more uniform quality is obtained, as well as the possibility of making blanks with a considerably shorter length.

The new and characterising aspects of the system, according to the invention, involve that at least two co-operating following means temporarily engage the wire, said engagement starting at least before or during the at least one operation, where at least one of said following means is rotating with an axis of rotation parallel to a first block and at least one second following means is rotating with an axis of rotation parallel to a second block, and where the rotation of said following means is synchronised with the rotation of at least one block, and where the following means in a first phase of engagement is gradually yielding and in a second phase of engagement gradually expanding to follow the wire.

By the new and characterising aspects of the system, it is obtained that the following means by their engagement with the wire stabilize and support the moving wire during the operation. Also, it is obtained that the following means may transport the blanks from the position, where they are separated from the wire, and over a distance to safe engagement with a transport unit. By these aspects both an improved as well as a more uniform quality is obtained, as well as the possibility of making blanks with a considerably shorter length.

The following means may each comprise an engagement face, said face comprising a recess for engagement of the wire. A recess is well suited in that it partly surrounds the wire to obtain a safe engagement and also has a centering effect on the wire.

The following means may each comprise a detachable member comprising the engagement face. The engagement face is subject to wear from the engagement with the wire and it is convenient to replace only the worn part.

In one embodiment the following means may comprise a number of rods, said rods being embedded in the blocks. By embedding the rods in the blocks, synchronisation of the movement of the rods and the blocks is given. By using rods a low mass of the following means is obtained, which decreases the centripetal forces at high rotation speeds.

The rods may in a preferred embodiment be engaged with and disengaged from the wire, by that said rods each are resiliently forced in a direction away from the axis of rotation by a spring element and during rotation applicably expanded and retracted, said expansion and retraction being controlled by a cam and said spring element. In this way, the rods may escape by deforming the spring elements, in case something unexpected should be caught between two co-operating rods. The cam controls the retraction and forces the rods against the spring elements.

In a further embodiment each of said rods may during rotation applicably be moved inwardly as well as outwardly relative to the axis of rotation, said movement being controlled by a guide rail.

The invention furthermore involves a manufacturing machine for the manufacture of nails incorporating a system according to one or more of claims 7–7.

In the following the invention is described with reference to the drawings which display examples of embodiments of the invention.

FIG. 1 is a side view of a system according to the invention

Figure 3A:
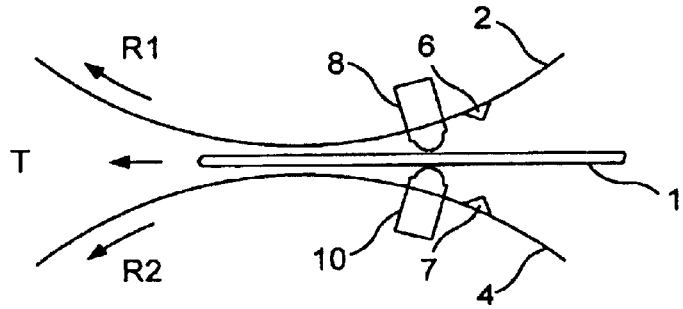
Figure 3B:
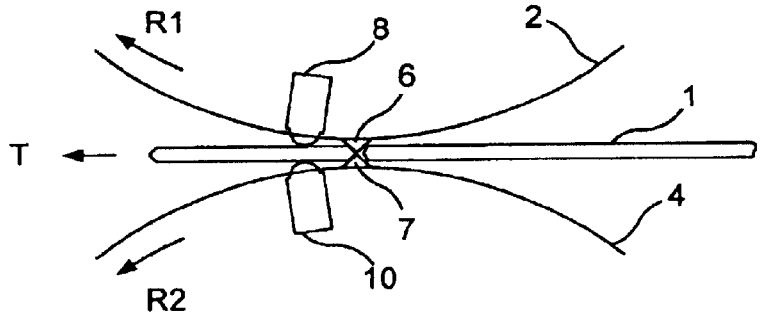
Figure 3C:
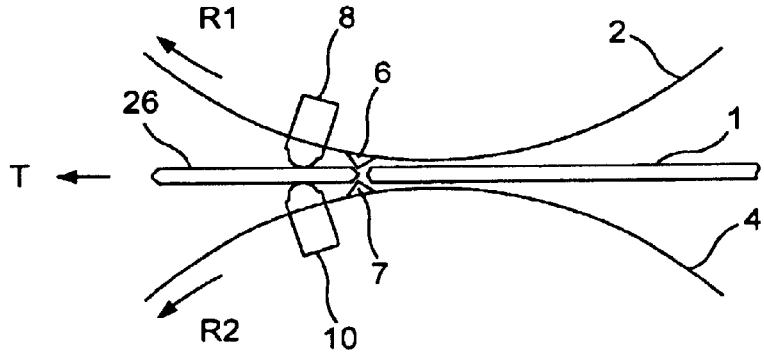
Figure 3D:
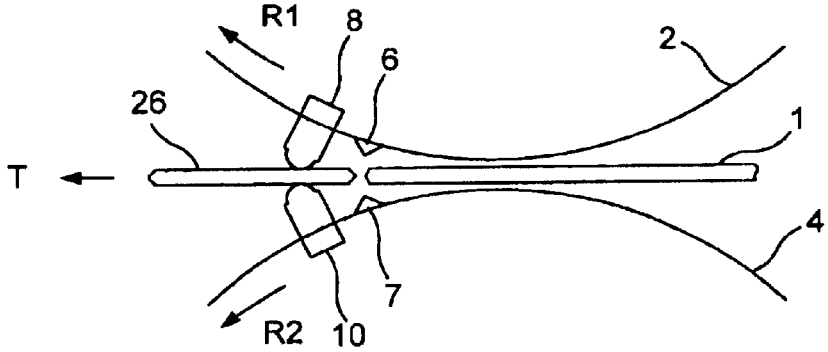
Figure 4A:
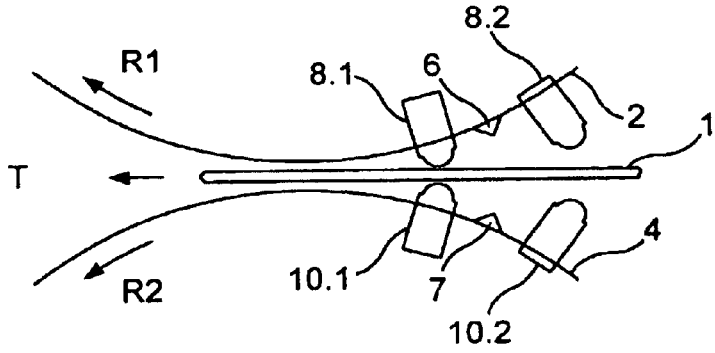
Figure 4B:
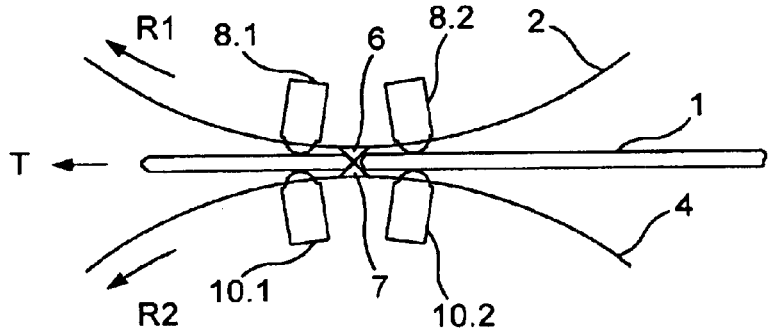
Figure 4C:
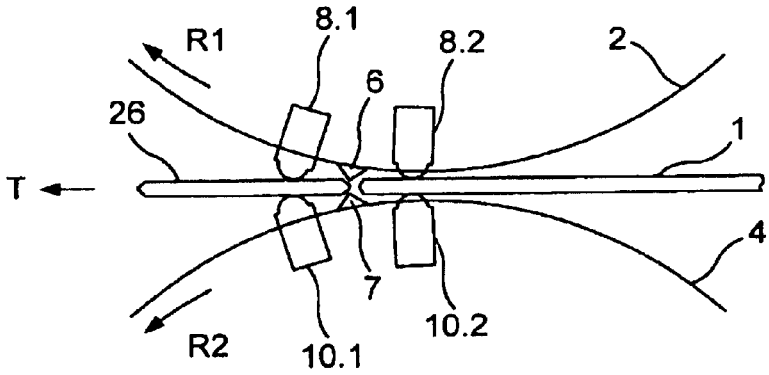
Figure 4D:
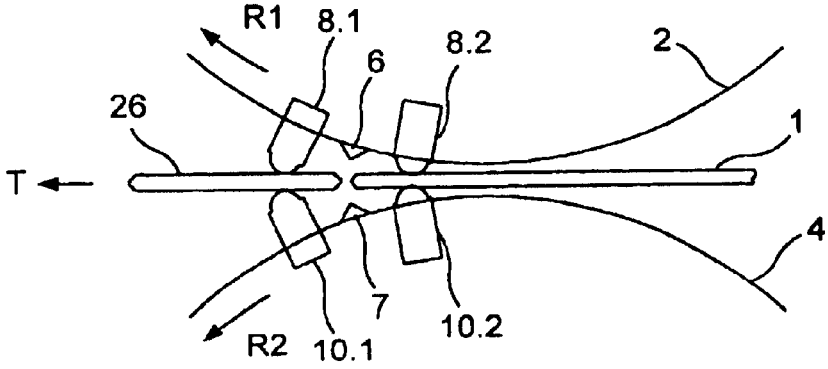
Figure 5A:
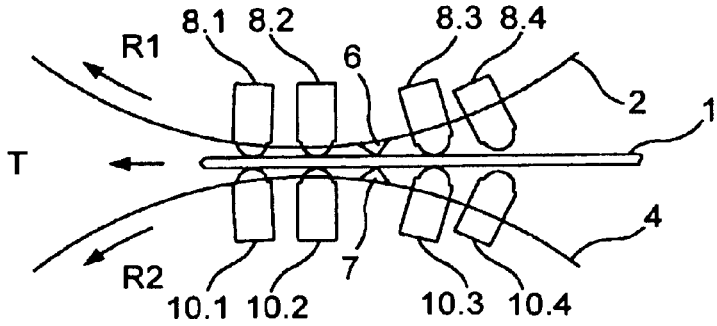
Figure 5B:
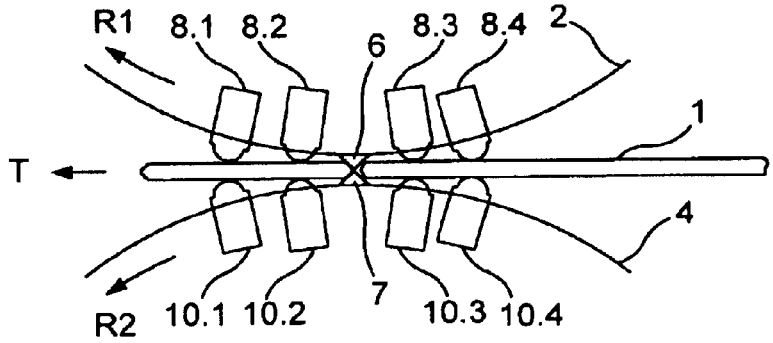
Figure 5C:
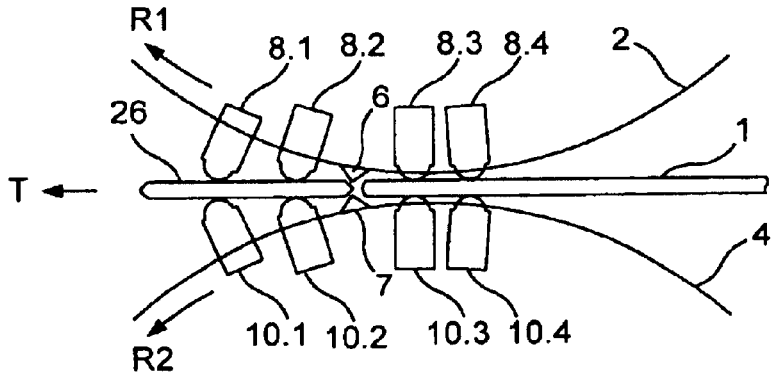
Figure 6:
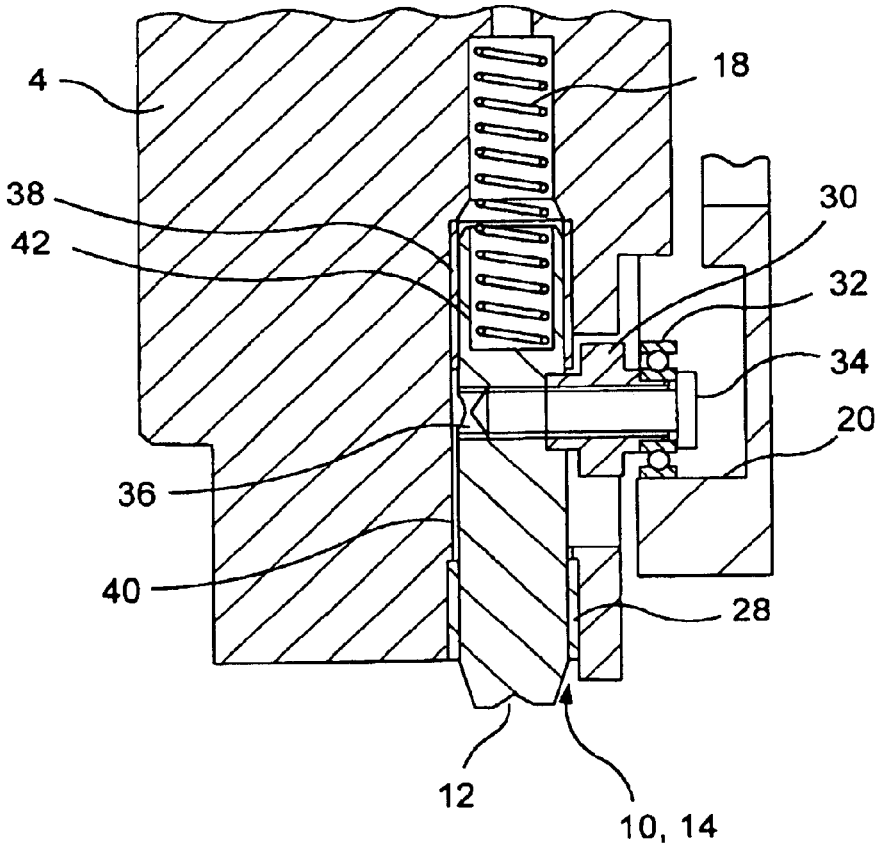

FIGS. 2*a–d* are schematic displays of the function of a system with one set of co-operating following means FIGS. 3*a–d* are schematic displays of the function of another system with one set of co-operating following means FIGS. 4*a–d* are schematic displays of the function of a system with two sets of co-operating following means FIGS. 5*a–c* are schematic displays of the function of a system with four sets of co-operating following means FIG. 6 is a cross-sectional view along the line A—A on FIG. 1

Figure 7:
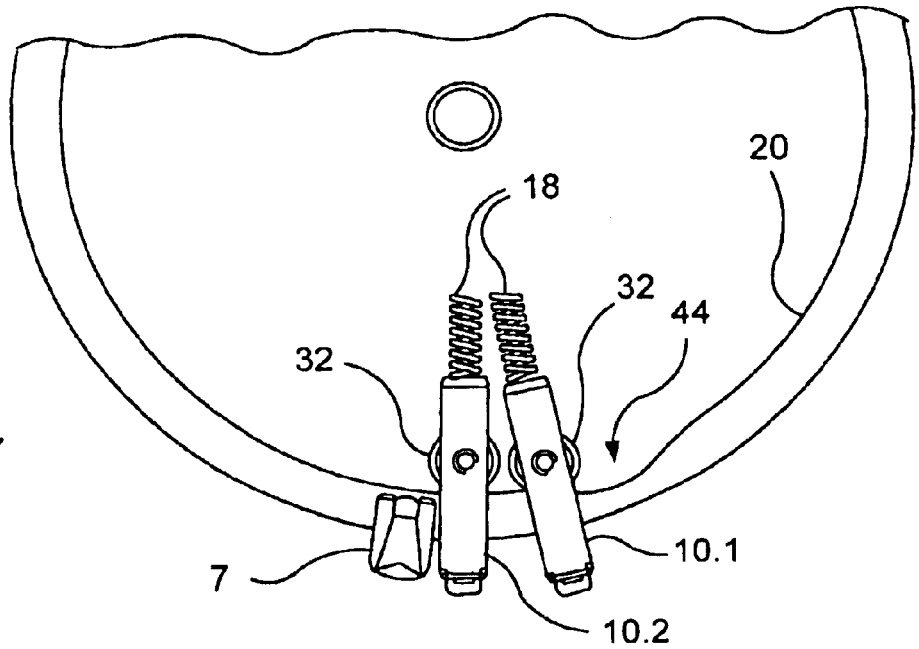
Figure 8:
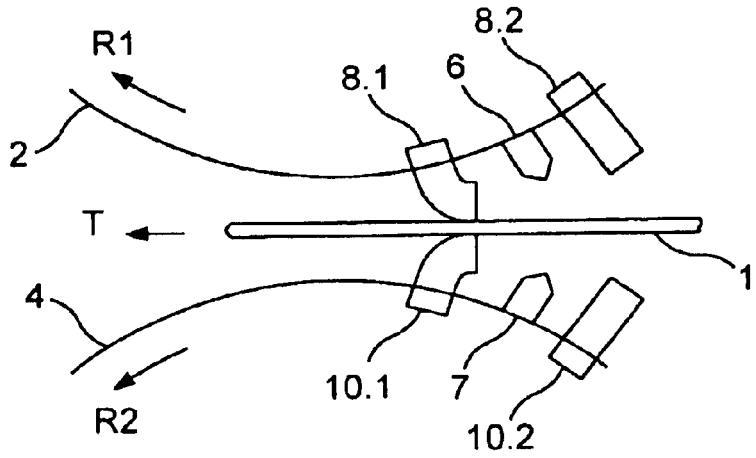
Figure 9:
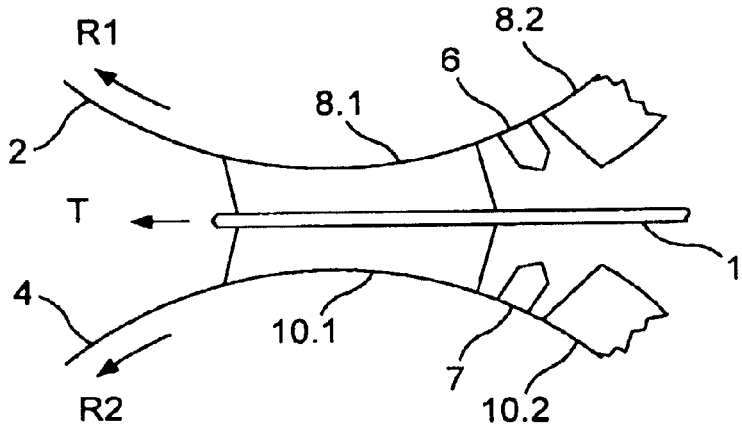
Figure 10:
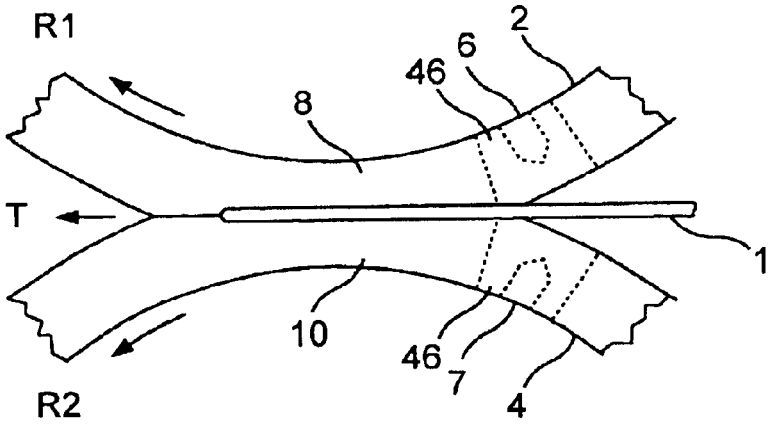

FIG. 7 is an explanatory side view of a cam with an indication of the position of two following means and an operation means FIGS. 8–10 are schematic displays of the function of a system in alternative embodiments FIG. 1 displays a wire 1 moving in the direction indicated by the arrow marked T towards a transport unit 22, which may comprise a number of rollers 24. The wire is cut into blanks, which are transferred to the transport unit. The blanks may for instance further be submitted to further processing into nails, spikes, screws etc. The wire is cut by means placed on by two rotating blocks 2 and 4, which are rotating in the directions indicated by the arrows marked R1 and R2. The block 2 includes a number of operation means 6 and following means 8.1 and 8.2. The block 4 includes a number of operation means 7 and following means 10.1 and 10.2. The following means may preferably be integrated with the blocks, but may also be placed separately and synchronised with the blocks. The rotation of the two blocks 2 and 4 is synchronised. The operation means 6 and 7 are co-operating to for instance cut the wire 1, making the acute end of a nail to the one side and the flat end to the other side. Instead of cutting, the operation could be any type of deformation and/or cold forming. Following means 8.1 and 10.1, as well as 8.2 and 10.2, are co-operating to engage the wire to at least support and stabilize the wire before or during the operation by the operation means 6 and 7.

The following means may further be used to assist in transporting the wire to the transport unit 22.

Figure 2A:
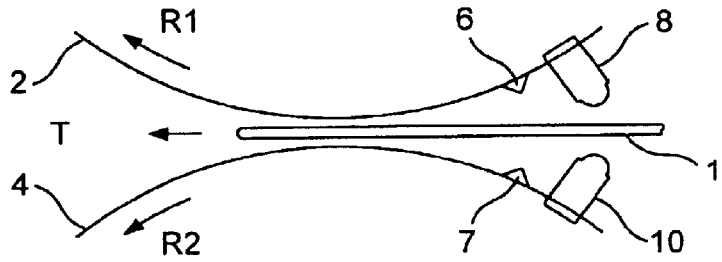
Figure 2B:
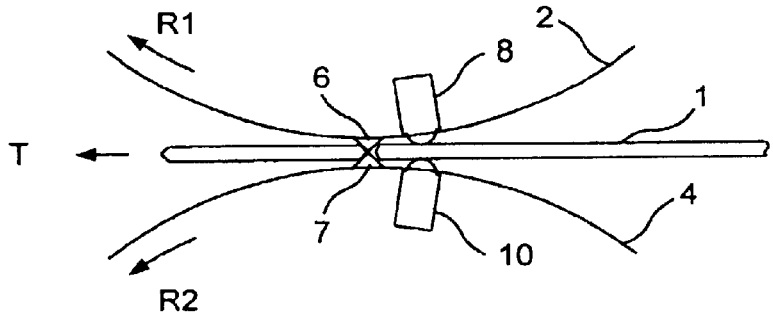
Figure 2C:
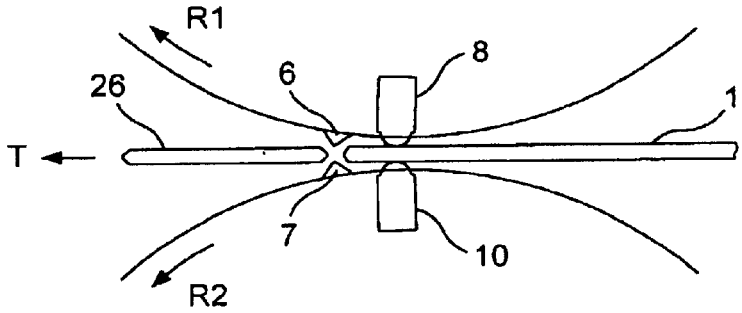
Figure 2D:
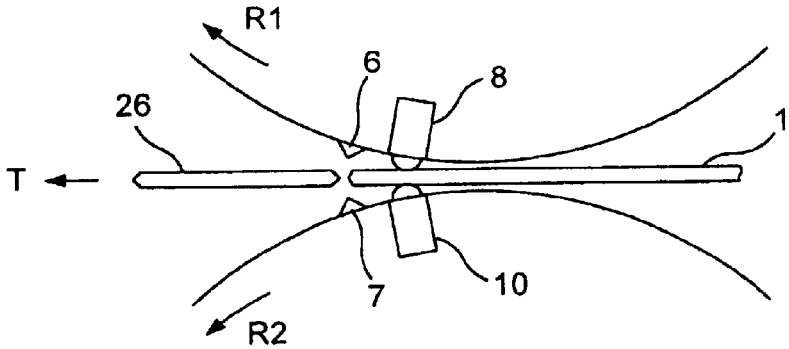

FIGS. 2*a–d* display rotating blocks 2 and 4 provided with operation means 6 and 7, and with following means 8 and 10. The blocks are rotating in the directions indicated by the arrows marked R1 and R2. A wire 1 is moved in the direction indicated by the arrow marked T. FIG. 2*a* displays a situation before the wire 1 is engaged. The following means 8 and 10 are expanded to maximum reach to engage the wire 1 as early as possible. The engagement may be obtained before or during an operation performed by the operation means 6 and 7. FIG. 2*b* displays a situation where the following means 8 and 10 have been engaged with the wire 1 and have yielded according to the decreased diameter needed at the shown position, compared to the position shown in FIG. 2*a*. By the engagement, the following means stabilize and support the wire, which enhances the quality and precision of the operation on the wire. In FIG. 2*c* the wire 1 has been cut through and a blank 26 has been formed. The free end of the wire is supported by the following means 8 and 10 also after the operation as shown in FIG. 2*d*. In the first phase of engagement, ref. FIGS. 2*a* and 2*b*, the following means 8 and 10 are yielding to the wire 1, or to each other, and later in a second phase, ref. FIGS. 2*c* and 2*d*, they are expanding, whereby the following means may keep the engagement with the wire 1 while rotating. In this way the wire 1 may be kept aligned and centered, so that for instance random stresses in the wire are at least partly restrained from bending the wire from the desired straight shape.

FIGS. 3*a–d* display rotating blocks 2 and 4 provided with operation means 6 and 7, and with following means 8 and 10. The blocks are rotating in the directions indicated by the arrows marked R1 and R2. A wire 1 is moved in the direction indicated by the arrow marked T. FIG. 3*a* displays a situation where the wire 1 is engaged by the following means 8 and 10. The engagement is thereby obtained before an operation is performed by the operation means 6 and 7. FIG. 3*b* displays a situation where the following means 8 and 10 have been engaged with the wire 1 and have yielded according to the decreased diameter needed at the shown position, compared to the position shown in FIG. 3*a*. In FIG. 3*c* the wire 1 has been cut through and a blank 26 has been formed. The blank 26 is supported by the following means 8 and 10, also after the operation as shown in FIG. 3*d*. In this way the wire 1 may be transported to an undisplayed transport unit (see FIG. 1). In FIG. 3*d* the transport of the blank 26 is shown. Also shown is that the following means 8 and 10 are expanding to maintain engagement with the blank 26.

FIGS. 4*a–d* display rotating blocks 2 and 4 provided with operation means 6 and 7, and with following means 8.1, 8.2 and 10.1, 10.2. The blocks are rotating in the directions indicated by the arrows marked R1 and R2. A wire 1 is moved in the direction indicated by the arrow marked T. FIG. 4*a* displays a situation where the wire 1 is engaged by the yielding following means 8.1 and 10.1. The engagement is thereby obtained before and during an operation is performed by the operation means 6 and 7. FIG. 4*b* displays a situation where the following means 8.2 and 10.2 also have been engaged with the wire 1. Both sets of following means 8.1 and 10.1 as well as 8.2 and 10.2 engage the wire 1 during the operation by the operation means 6 and 7. In this way the wire 1 is supported and stabilized on both sides of the operation, whereby the wire 1 may be placed and kept very accurately relative to the operation means 6 and 7. In FIG. 4*c* the wire 1 has been cut through and a blank 26 has been formed. The blank 26 is supported by the following means 8.1 and 10.1 also after the operation as shown in FIG. 4*d*. The free end of the wire 1 is supported by the following means 8.2 and 10.2. In FIG. 4*d* the transport of the blank 26 is shown and that the following means 8 and 10 are expanding to maintain engagement with the blank 26. Also the following means 8.2 and 10.2 are expanding to maintain engagement with the wire.

FIGS. 5*a–c* display rotating blocks 2 and 4 provided with operation means 6 and 7, and with following means 8.1, 8.2, 8.3, 8.4 and 10.1, 10.2, 10.3, 10.4. The blocks are rotating in the directions indicated by the arrows marked R1 and R2. A wire 1 is moved in the direction indicated by the arrow marked T. FIG. 5*a* displays a situation where the wire 1 is engaged by the following means 8.1, 8.2, 8.3 and 10.1, 10.2, 10.3. The engagement is thereby obtained before and during an operation is performed by the operation means 6 and 7. FIG. 5*b* displays a situation where all the following means are engaged during the operation, whereby increased stability, support and precision is obtained. In FIG. 5*c* the wire 1 has been cut through and a blank 26 has been formed. The blank 26 is supported by the following means 8.1, 8.2 and 10.1, 10.2 also after the operation shown in FIG. 5*b*. The free end of the wire 1 is supported by the following means 8.3, 8.4 and 10.3, 10.4. In FIG. 5*c* the transport of the blank 26 is shown, where both following means 8.1 and 10.1 as well as 8.2 and 10.2 are engaged, which gives a very stable and secure transport of the blank.

FIG. 6 displays a block 4 comprising a hole 40 where a following means 10 is placed, said following means comprising a rod 14. The end of the rod 14, which comprises the engagement face, is provided with a groove 12. The tip of the rod 14 may be detachable for easy replacement of a worn part. The rod 14 is placed in the hole 40 and guided by two sliding bearings 28 and 38. The rod 14 is further provided with a hole 42, where a spring element 18 is placed. The spring element may as shown be a helical spring. The spring element 18 forces the rod 14 in the direction of the recess 12. To keep the rod 14 in place and jointly with the spring element control expansion and retraction, a non-rotating cam 20 is provided, where a wheel or a ball bearing 32 via a bushing 30 and a screw 34 is connected to the rod 14. The screw 34 is inserted in the threaded hole 36 in the rod 14. When the block 4 is rotated while the cam 20 remains fixed, the ball bearing 32 will be running on the cam 20, to which it is forced into contact with by the spring element 18. By providing the cam 20 with an appropriate geometry, expansion and retraction of the rod 14 is controlled. The centripetal force acting on the rod 14 during rotation increases the contact between the ball bearing 32 and the cam 20.

FIG. 7 displays a cam 20 provided with a zone 44, where the diameter is increased. For explanatory purposes, two following means 10.1 and 10.2 are indicated along with an operation means 7. Two spring elements 18 are forcing the following means 10.1 and 10.2 away from the centre of rotation. Two ball bearings 32 are in contact with the cam 20 including the zone 44. When the ball bearings 32 pass the zone 44 the following means 10.1 and 10.2 are first expanded outwardly and afterwards retracted inwardly during the passage.

The movement inwardly and outwardly of following means 8 and 10 may also be controlled by a guide rail, which is equivalent to both an inward and an outward cam. The use of the cam 20 and spring element 18 is, however, preferred, since the following means may yield inwardly in case of a malfunction because of the spring element 18.

FIGS. 8–10 displays rotating blocks 2 and 4 provided with operation means 6 and 7. The blocks are rotating in the directions indicated by the arrows marked R1 and R2. A wire 1 is moved in the direction indicated by the arrow marked T.

In the embodiment shown in FIG. 8, the following means 8.1, 8.2 and 10.1, 10.2 are elastic, bendable fingers, e.g. made from rubber, so that they at first bend to decrease effective length and engage the wire during rotation, and at a later phase unbend to increase the effective length to follow the wire.

In the embodiment shown in FIG. 9, the following means 8.1, 8.2 and 10.1, 10.2 are elastic, deformable blocks, e.g. made from rubber, so that they at first deform to decrease effective length and engage the wire during rotation, and at a later phase expand to increase the effective length to follow the wire.

In the embodiment shown in FIG. 10, the following means 8 and 10 are elastic rings, e.g. made from rubber, said rings being provided with grooves 46, where the operation means 6 and 7 are placed. The rings at first deform to decrease effective length and engage the wire during rotation, and at a later phase expand to increase the effective length to follow the wire.

It is to be understood that not only a cutting operation may be performed on the wire, but also a sequence of different operations e.g. for shaping the nail, spike etc., before the individual items are separated. Also, during said sequence of operations, following means may be used to stabilize, support and/or transport the wire. Also, more than one wire may be processed at a time, for instance two or three parallel wires. Following means for more wires may be placed on one block.

What is claimed is:

1. A method of carrying out at least one operation on at least one wire(2) in a wire forming manufacturing machine, said operation involving deformation of at least a part of the wire, said machine comprising at least two counter-rotating synchronised blocks(2,4), said blocks each comprising at least one operation means(6,7) for performing said operation, characterised in that at least two co-operating following means(8,10) temporarily engage the wire, said engagement starting at least before or during the at least one operation, where at least one of said following means(8) is rotating with an axis of rotation parallel to a first block(2) and at least one second following means(10) is rotating with an axis of rotation parallel to a second block(4), and where the rotation of said following means is synchronised with the rotation of at least one block, and where the following means in a first phase of engagement is gradually yielding and in a second phase of engagement gradually expanding to follow the wire.

2. A method according to claim 1, characterised in that the following means(8,10) engages the wire(1) following the at least one operation.

3. A method according to claim 1, characterised in that that following means, (8, 10) are retracted towards each respective axis of rotation following the second phase of engagement.

4. A method according to claim 1, characterised in that following means (8, 10) are acting on the side of the operation means (6,7), whose side is opposite the direction of rotation.

5. A method according to claim 1, characterised in that the following means (8, 10) are acting on the side of the operation means (6, 7) whose side is in the direction of rotation.

6. A method according to claim 1, characterised in that the following means (8, 10) are acting both on the side of the operation means (6, 7) whose side is opposite the direction of rotation, and acting on the side of the operation means, whose side is in the direction of rotation.

7. A system for carrying out at least one operation on at least one wire(1) in a wire forming manufacturing machine, said operation involving deformation of at least a part of the wire, said machine comprising at least two counter-rotating synchronised blocks(2,4), said blocks each comprising at least one operation means(6,7) for performing said operation, characterised in that said system comprises at least two co-operating following means(8,10), said following means temporarily engaging the wire, said engagement starting at least before or during the at least one operation, where at least one of said following means is rotating with an axis of rotation parallel to a first block(2) and at least one second following means is rotating with an axis of rotation parallel to a second block(4), and where the rotation of said following means is synchronised with the rotation of at least one block, and where the following means in a first phase of engagement is gradually yielding and in a second phase of engagement gradually expanding to follow the wire.

8. A system according to claim 7, characterised in that the following means(8,10) engages the wire(1) following the at least one operation.

9. A system according to claim 7, characterised in that the following means (8, 10) each compromise an engagement face, said face comprising a recess (12) for engagement of the wire.

10. A system according to claim 9, characterised in that the following means(8,10) each comprises a detachable member comprising the engagement face.

11. A system according to claim 7, characterised in that the following means(8,10) comprise a number of rods(14), said rods being embedded in the blocks(2,4).

12. A system according to claim 11, characterised in that the rods(14) are engaged with and disengaged from the wire(1), by that said rods each are resiliently forced in a direction away from the axis of rotation by a spring element (18) and during rotation applicably expanded and retracted, said expansion and retraction being controlled by a cam(20) and said spring element.

13. A system according to claim 11, characterised in that each of said rods(14) during rotation applicably are moved inwardly as well as outwardly relative to the axis of rotation, said movement being controlled by a guide rail.

14. A system according to claim 7, characterised in that the following means(8,10) are retracted inwardly towards the axis of rotation following the second phase of engagement.

15. A system according to claim 7, characterised in that following means(8,10) at least are acting on the side of the operation means(6,7), whose side is opposite the direction of rotation.

16. A system according to claim 7, characterised in that the following means(8,10) at least are acting on the side of the operation means(6,7), whose side is in the direction of rotation.

17. A system according to claim 7, characterised in that following means(8,10) are acting both on the side of the operation means(6,7), whose side is opposite the direction of rotation, and acting on the side of the operation means(6,7), whose side is in the direction of rotation.

18. A manufacturing machine for the manufacture of nails incorporating a system according to claim 7.

* * * * *